US008411889B2

(12) United States Patent
Naumann et al.

(10) Patent No.: US 8,411,889 B2
(45) Date of Patent: Apr. 2, 2013

(54) HEARING SYSTEM WITH POSITIONING DEVICE AND CORRESPONDING POSITIONING METHOD

(75) Inventors: Frank Naumann, Erlangen (DE); Uwe Rass, Nürnberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 178 days.

(21) Appl. No.: 13/018,778

(22) Filed: Feb. 1, 2011

(65) Prior Publication Data

US 2011/0188692 A1 Aug. 4, 2011

(30) Foreign Application Priority Data

Feb. 1, 2010 (DE) ..... 10 2010 006 359

(51) Int. Cl.
*H04R 25/00* (2006.01)

(52) U.S. Cl. ..... 381/329; 381/322; 381/328

(58) Field of Classification Search ..... 381/322, 381/324–325, 328–329
See application file for complete search history.

(56) References Cited

U.S. PATENT DOCUMENTS

| | | | | |
|---|---|---|---|---|
| 4,539,440 | A | 9/1985 | Sciarra | |
| 4,756,312 | A | 7/1988 | Epley | |
| 6,055,319 | A | 4/2000 | Shennib et al. | |
| 6,094,494 | A | 7/2000 | Haroldson | |
| 6,529,609 | B1 | 3/2003 | Neilson et al. | |
| 7,388,961 | B2 * | 6/2008 | Shennib et al. | 381/329 |
| 7,466,836 | B2 * | 12/2008 | Tilson et al. | 381/329 |
| 2005/0249370 | A1 | 11/2005 | Shennib | |
| 2009/0082801 | A1 | 3/2009 | Giese et al. | |

FOREIGN PATENT DOCUMENTS

| | | | |
|---|---|---|---|
| DE | 29608352 | U1 | 10/1996 |
| EP | 2040488 | A2 | 3/2009 |
| WO | 9907182 | A2 | 2/1999 |
| WO | 2005077011 | A2 | 8/2005 |

* cited by examiner

*Primary Examiner* — Suhan Ni
(74) *Attorney, Agent, or Firm* — Laurence A. Greenberg; Werner H. Stemer; Ralph E. Locher

(57) ABSTRACT

A hearing aid can be inserted deep inside an auditory canal without the risk of injury. The hearing system has a hearing device that can be completely inserted into a human auditory canal, and a positioning device, which is attached to the hearing device in a self-retaining manner. The positioning device can be detached from the hearing device, when the latter is in the state where it is inserted into the auditory canal, and cannot or can only partly be inserted into the auditory canal because it serves as a stop on a section of the concha when the hearing device is being positioned. The positioning device is decoupled from the hearing device after placement and removed from the auditory canal.

20 Claims, 4 Drawing Sheets

HEARING SYSTEM WITH POSITIONING DEVICE AND CORRESPONDING POSITIONING METHOD

CROSS-REFERENCE TO RELATED APPLICATION

This application claims the priority, under 35 U.S.C. §119, of German patent application DE 10 2010 006 359.2, filed Feb. 1, 2010; the prior application is herewith incorporated by reference in its entirety.

BACKGROUND OF THE INVENTION

Field of the Invention

The present invention relates to a hearing system with a hearing device that can be completely inserted into a human auditory canal. Moreover, the present invention relates to a method for positioning a hearing device in a human auditory canal.

Hearing aids are portable hearing devices used to support the hard-of-hearing. In order to make concessions for the numerous individual requirements, different types of hearing aids are provided, e.g. behind-the-ear (BTE) hearing aids, hearing aids with an external receiver (receiver in the canal—RIC) and in-the-ear (ITE) hearing aids, for example concha hearing aids or canal hearing aids (ITE, CIC) as well. The hearing aids listed in an exemplary manner are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually designed as an electroacoustic transducer, e.g. a miniaturized loudspeaker, or as an electromechanical transducer, e.g. a bone conduction receiver. The amplifier is usually integrated into a signal-processing unit (SPU). This basic design is illustrated in FIG. 1 by way of the example of a behind-the-ear hearing aid. One or more microphones 2 for recording the sound from the surroundings are installed in a hearing aid housing 1 to be worn behind the ear. A signal-processing unit 3 (SPU), likewise integrated into the hearing aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer by means of a sound tube, which is fixed in the auditory canal with an ear mold. A battery 5 (BAT), likewise integrated into the hearing aid housing 1, supplies the hearing aid, in particular the signal-processing unit 3, with energy.

CIC hearing aids are worn completely in the auditory canal, i.e. no section of the hearing aid protrudes out of the entrance to the auditory canal. The deeper the hearing aid can be inserted into the auditory canal, i.e. the closer the hearing aid output is arranged with respect to the eardrum, the better the effectiveness of the hearing aid.

Thus, the challenge in the case of such CIC hearing aids lies in placing these hearing aids very deeply inside the ear canal or the auditory canal, i.e., as close as possible to the eardrum. Not only is the hearing aid virtually invisible from the outside in this operational position, but also an improved acoustic performance is obtained and less amplification is required, which ultimately also leads to lower energy consumption.

However, the problem here is that very deep insertion of the hearing aid into the ear canal is not easy. There is always a considerable risk of injuring the eardrum when inserting the hearing aid.

Currently available hearing aids must be inserted by clinically trained personnel. This is not advantageous because it involves much effort on the part of the hearing-aid wearer. If the hearing-aid wearers themselves remove the aid from the auditory canal, they cannot simply reinsert it.

Commonly assigned U.S. Patent Application Publication No. US 2009/0082801 A1 and its counterpart European published patent application EP 2 040 488 A2 describe a tool for inserting a receiver of a hearing device into an auditory canal. The tool has a forceps with a first and a second forceps arm, which are attached to one another at one end. At its free end, the first forceps arm has a holding apparatus, by means of which the receiver to be held should be blocked in respect of movements in at least three directions. Moreover, at least one of the two forceps arms has a stop, which protrudes substantially laterally from the forceps arm and is used for butting against a concha of the user when inserting the receiver. This firstly provides good grip of the external receiver and secondly allows the insertion thereof into the auditory canal at a defined depth.

SUMMARY OF THE INVENTION

It is accordingly an object of the invention to provide a hearing system and method with a positioning device which overcome the above-mentioned disadvantages of the heretofore-known devices and methods of this general type and which provides for a system that allows the deepest possible insertion of a hearing device into an auditory canal, without requiring much effort and without exposing the eardrum to a high risk of injury.

With the foregoing and other objects in view there is provided, in accordance with the invention, a hearing system, comprising:

a hearing device configured for complete insertion into a human auditory canal;

a positioning device releasably attached to the hearing device in a self-retaining manner, wherein the positioning device is detached from the hearing device when the hearing device is inserted in the auditory canal, the positioning device cannot be inserted, or can only be partly inserted, into the auditory canal, and the positioning device serves as an insertion stop on a part of a concha at an entrance to the auditory canal during a positioning of the hearing device in the auditory canal.

In other words, the objects of the invention are achieved by a hearing system with a hearing device that can be completely inserted into a human auditory canal, and a positioning device, which is attached to the hearing device in a self-retaining manner, which can be detached from the hearing device when the latter is in the state where it is inserted into the auditory canal, which cannot or can only partly be inserted into the auditory canal, and which serves as a stop on a section of a concha when positioning the hearing device.

Moreover, the aforementioned object is achieved by a method for positioning a hearing device in a human auditory canal by attaching a positioning device to the hearing device, such that both are interconnected in a self-retaining manner, completely inserting the hearing device into the auditory canal with the aid of the positioning device until the positioning device butts against a section of the concha, and detaching the positioning device from the hearing device such that the hearing device alone remains in the auditory canal.

The positioning device advantageously constitutes a positioning aid for completely pressing the hearing device and, more particularly, the hearing aid into the auditory canal. The presence of a stop can ensure that the hearing device is not pressed too far into the auditory canal, which removes the risk of injuring the eardrum.

In a preferred embodiment of the invention, the hearing device is individually fitted to the auditory canal. This can bring about an optimum seating of the hearing device in the auditory canal at a predetermined position.

Moreover, it is advantageous for the positioning device to be individually fitted to the form of the entrance to the auditory canal. This allows the implementation of an individualized stop of the positioning device, as a result of which, ultimately, the insertion depth of the hearing device in the auditory canal can be set precisely and can be obtained in an easily reproducible manner.

Moreover, the positioning device can have a tube or a bolt, and the hearing device can be detachably arranged at one end of the tube or of the bolt. The length of the tube or of the pin can easily set the individual insertion depth into the auditory canal.

A pin can be arranged in the tube of the positioning device, which pin is rotated about its axis or axially displaced in the tube for detaching the hearing device from the positioning device. This allows the positioning device to be detached from the hearing device by a simple movement of the hand.

In a special embodiment, the pin, in a first position, partly presses a ball, situated in the tube, out of the tube in a radial direction and, in a second position, provides sufficient space in the tube such that the ball is located entirely within the circumference of the tube. This brings about a deflection of an axial movement into a radial movement in a simple manner, by means of which the positioning device can be locked in the hearing device.

In accordance with an alternative embodiment, the pin of the positioning device has a segment, which undercuts a projection of the hearing device in the state where the positioning device is attached to the hearing device, with the undercut being released for detaching the positioning device from the hearing device. This can bring about, and rerelease, the connection between positioning apparatus and hearing device by means of a simple rotation of the pin.

The bolt or the tube can be inserted into a recess of the hearing device under magnetic guidance for the purpose of attaching it in the hearing device. This can simplify the process of connecting the positioning device to the hearing device when the hearing device is in the auditory canal and the user cannot see the two components.

In accordance with an alternative embodiment of the invention, the positioning device is detachably attached to the hearing device by negative pressure (i.e., vacuum suction) or by magnetic force. In both cases, fixing the positioning device to the hearing device is, at least primarily, not brought about by manual force, but by another physical force.

Other features which are considered as characteristic for the invention are set forth in the appended claims.

Although the invention is illustrated and described herein as embodied in a hearing system with positioning device and corresponding positioning method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
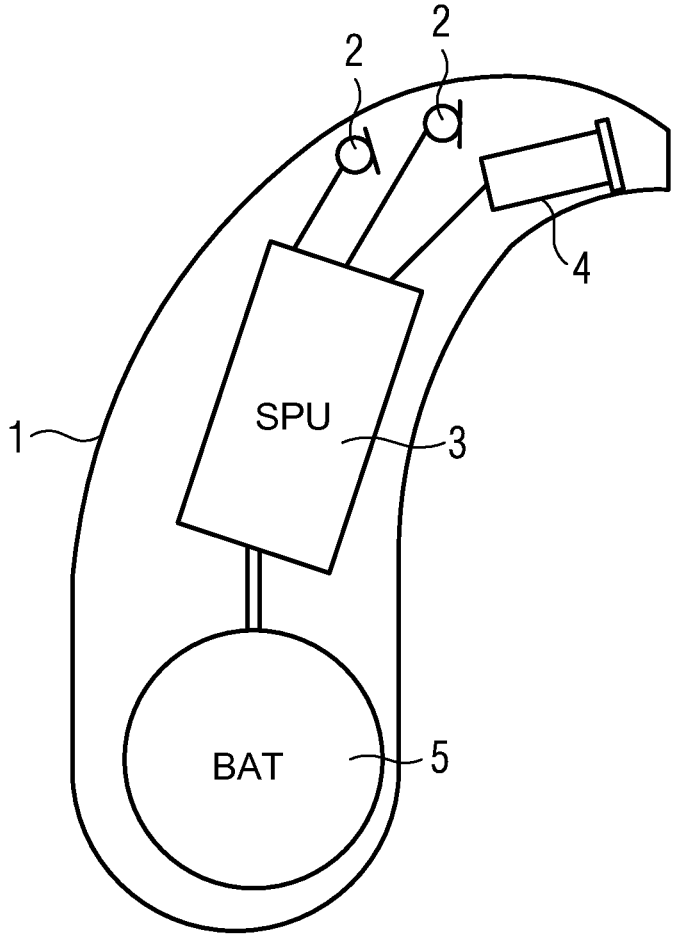
FIG. 1 PRIOR ART
FIG. 1 shows the schematic design of a hearing aid as per the prior art.
Figure 2:
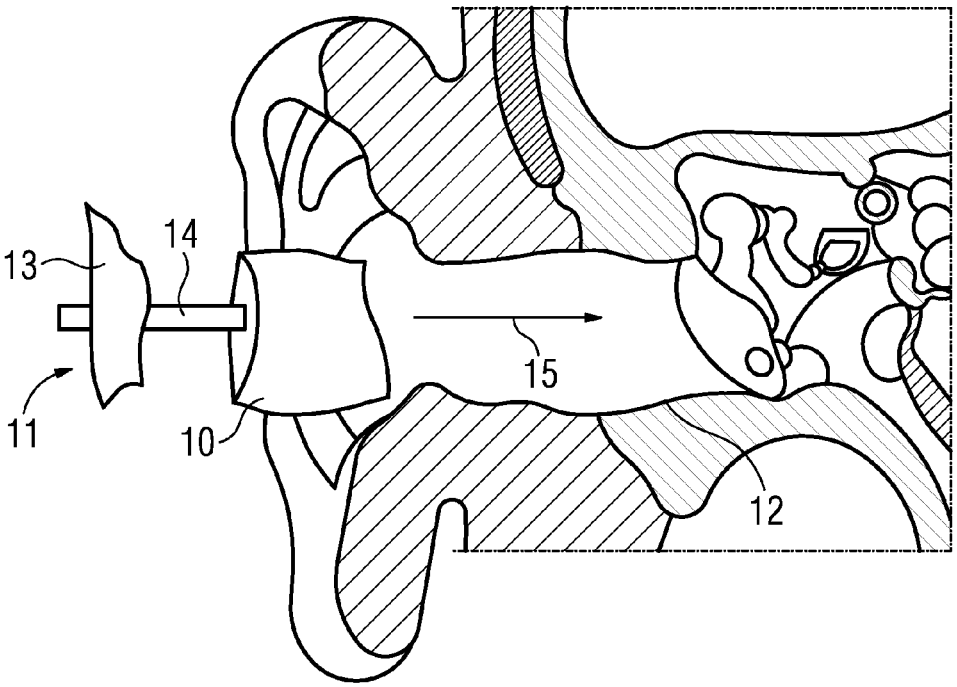
FIG. 2 shows a hearing system according to the invention before being inserted into the auditory canal.
Figure 3:
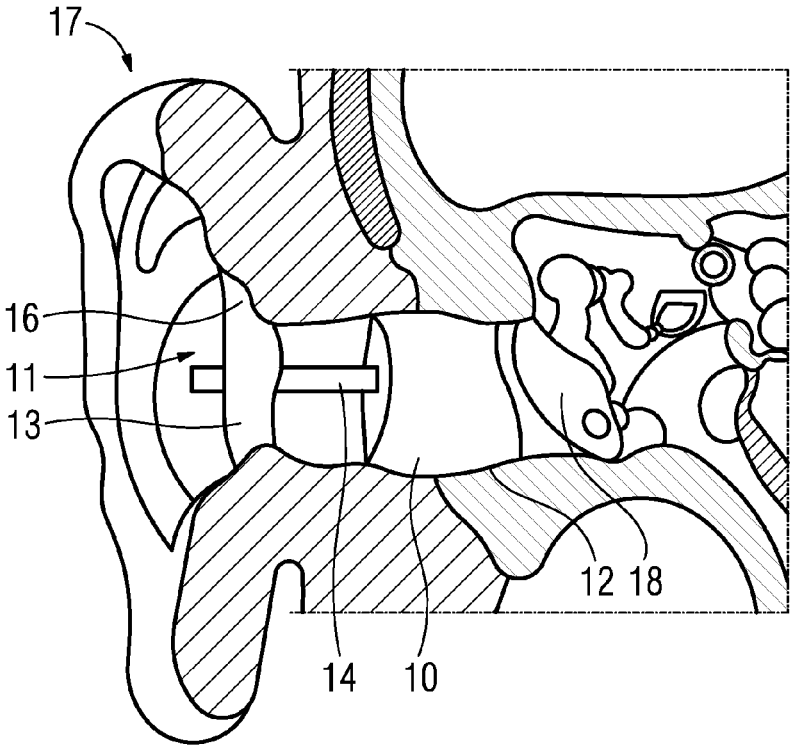
FIG. 3 shows the hearing system from FIG. 2 in the inserted state.

The exemplary embodiments described herein with reference to the drawing figures constitute preferred embodiments of the present invention.

As mentioned, the primary object of the present invention is related to rendering the insertion and penetration of the hearing aid, or another hearing device, into the auditory canal to be as simple and safe as possible. The basic concept is to temporarily attach a positioning device, or a positioning adaptor, to the hearing aid for inserting the latter. The two components are then attached to one another in a self-retaining manner, and so no force has to be applied from the outside for the connection thereof.

FIGS. 2 to 5 pictorially illustrate, step-by-step, the insertion of a CIC hearing aid, which no longer protrudes from the auditory canal in the inserted state, on the basis of the hearing system according to the invention.

In the present example, the entire hearing system consists of two individually produced parts: the actual hearing aid 10, with its individually produced shell, and the positioning device 11, which likewise has an individually produced external contour. The two components are attached to one another, as per FIG. 2. However, they can be decoupled from one another after the hearing aid 10 has been inserted into the auditory canal 12.

In this case the positioning device 11 consists of a molded body 13, and a bolt or a connecting rod 14, which connects the molded body 13 to the hearing aid 10. The connecting rod 14 connects the two components 10 and 11 in a fixed but mutually detachable manner. This means that no force has to be exerted from the outside in order to keep the two components attached to one another. It is merely for inserting the hearing aid 10 into the auditory canal 12 that the positioning device 11 is temporarily attached to the hearing aid 10.

The hearing system 10, 11 is now inserted into the auditory canal 12 in accordance with the arrow 15. It is inserted until the molded body 13 of the positioning device 11 butts against a section 16 of the concha 17 (cf. FIG. 3). The molded body 13 has a slightly larger diameter than the auditory canal 12. This ensures a secure stop at/around the entrance to the auditory canal.

The length of the connecting rod 14 between the molded body 13 and the hearing aid 10 has been selected such that the hearing aid 10 is seated at the desired depth within the auditory canal 12 when the molded body 13 butts against the entrance to the auditory canal 12. By way of example, the hearing aid 10 is then seated at a depth such that there is a predetermined distance between the eardrum 18 and the side of the hearing aid 10 facing the eardrum 18. This distance, and hence the space between the eardrum 18 and the hearing aid 10, is preferably as small as possible, such that the acoustic transmission between hearing aid 10 and eardrum 18 is as efficient as possible.

Figure 4:
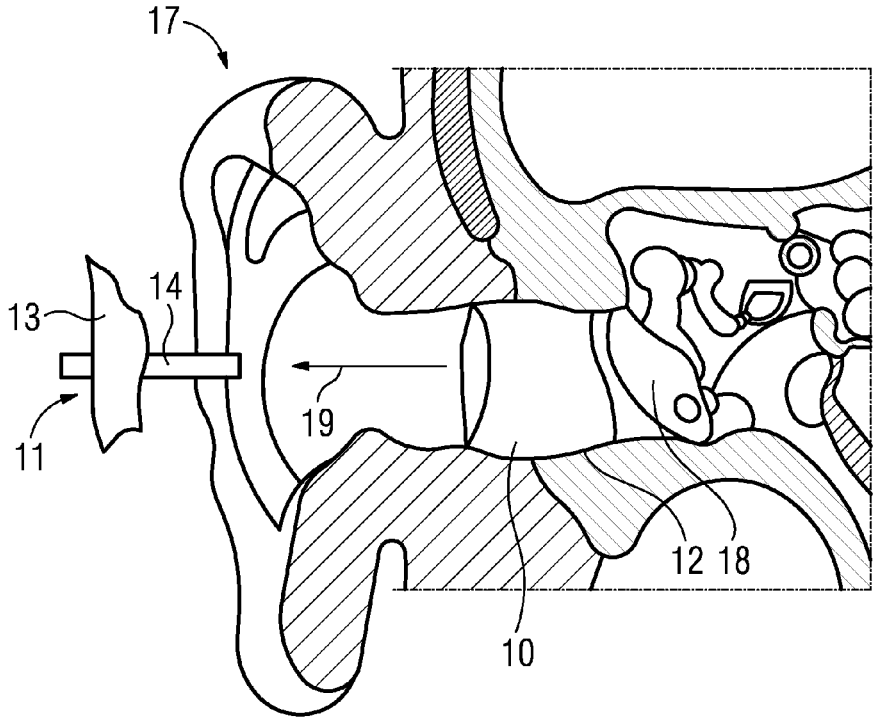
FIG. 4 shows the hearing system from FIG. 3 with a detached positioning device.
Figure 5:
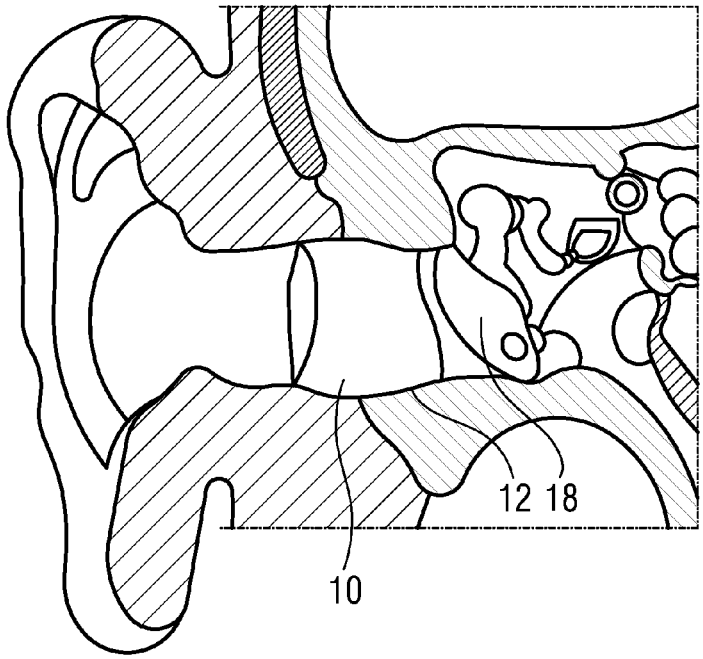
FIG. 5 shows the hearing aid of the hearing system from FIG. 3 in the inserted, operational state.

After the hearing aid 10 has reached its final position in the auditory canal 12, the positioning device 11 is decoupled from the hearing aid 10, as per FIG. 4. This is brought about by unlocking the connecting rod 14 from the hearing aid 10, such that it can be removed in the axial direction from the hearing aid 10 in the direction of the arrow 19 and, furthermore, from the auditory canal 12. Finally, the hearing aid 10 remains in the desired position in the ear canal 12, as shown in FIG. 5.

An exemplary embodiment will now be explained with reference to FIGS. 6 and 7, as to how the positioning device 11 can be coupled to the hearing aid or the hearing device 10. It can be gathered from FIG. 6 that the hearing aid, in this case a CIC hearing aid (as in FIGS. 2 to 5 as well), has an individually shaped shell. It is thus fitted to the auditory canal of the hearing-aid wearer. The hearing aid 10 has a bore or a blind hole 20, into which the connecting rod 14 of the positioning device 11 has been inserted. The connecting rod 14 is a fixed component of the positioning device 11, and the molded body 13 is molded thereon. The molded body 13 likewise has an individual shape. More particularly, as already indicated above, it is fitted to the entrance region of the auditory canal of the hearing-aid wearer. It is used as a stop and therefore has a greater maximum diameter than the hearing aid 10.

In the present example the connecting rod 14 has a tube 21 in which a pin 22 is guided in the axial direction. The molded body 13 is arranged at one end of the tube 21, while the other end of the tube 21 is inserted in the blind hole 20 of the hearing aid 10.

Figure 6:
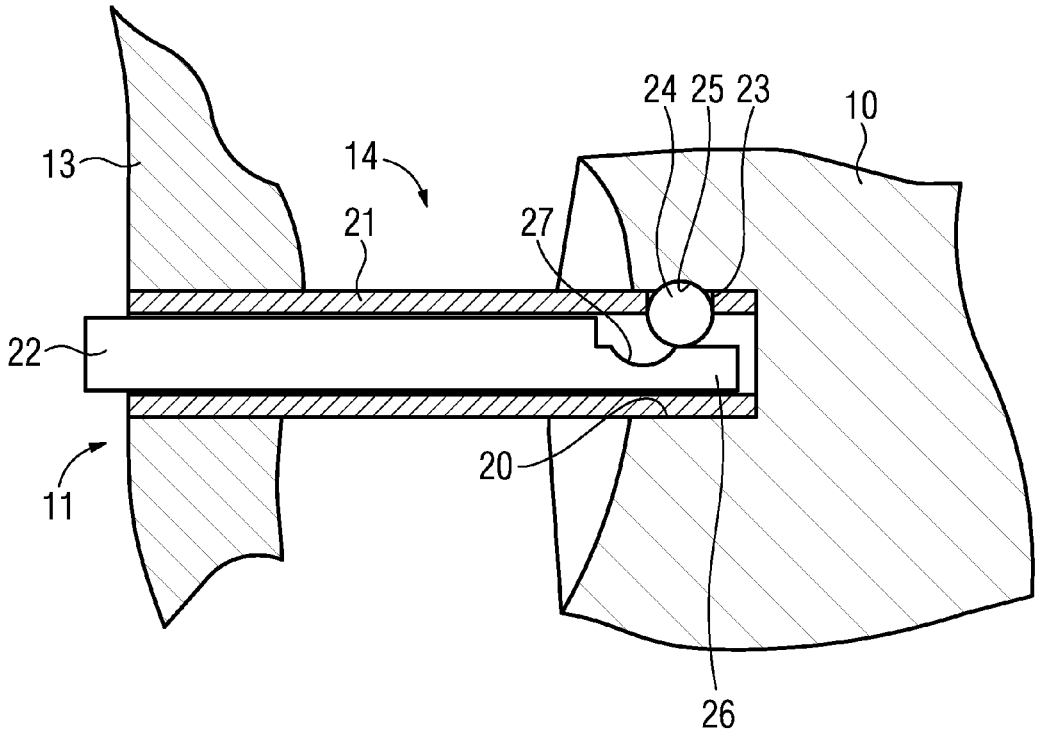
FIG. 6 shows a cross section through a hearing system in the attached state.

In the position of FIG. 6, the pin 22 protrudes from the tube 21 on the side of the molded body 13, with the tube ending flush with the surface of the molded body 13. Hence the pin 22 also protrudes from the surface of the molded body 13.

The end section of the tube 21, located in the blind hole 20 of the hearing aid 10, has a bore 23, which is directed radially outward and through which a ball 24 partly protrudes to the outside. That is to say, in the position of FIG. 6, part of the ball protrudes beyond the circumference of the tube 21 into a spherical-cap impression 25 in the blind hole 20. The connecting rod 14 is connected to the hearing aid 10 in an interlocking manner in this position of the ball 24. The spherical-cap impression 25 is the negative shape of a universal ball joint, constitutes an undercut in the blind hole 20 and thus permits locking of the connecting rod 14 in the blind hole 20 of the hearing aid 10.

The ball 24 is kept in the locking position of FIG. 6 as a result of the special shape of the pin 22. To this end, the pin 22 has a support section 26, which, provided it is below the ball 24, presses the latter out of the bore 23 of the tube 21 and into the spherical-cap impression 25. The support section 26 is adjoined by a depression 27 in the pin 22, which depression develops its function in conjunction with the unlocking (cf. FIG. 7). By way of example, the pin 22 is held in its locking position by an elastic force (not illustrated in any more detail in FIG. 6). Here, the pin protrudes axially from the tube 21 or the molded body 13, as mentioned, and secondly supports the ball 24 such that interlocking with the hearing aid 10 is ensured.

The connection mechanism between the two components must be unlocked for it to be possible to separate the positioning device 11 from the hearing aid 10. By way of example, to this end, the pin 22 is manually pressed into the tube 21 against the elastic force. The axial displacement of the pin 22 with respect to the tube 21 leads to the ball 24 falling into the depression 27, and thus being removed from the spherical-cap impression 25. Hence there is no longer an interlock between the positioning device 11 and the hearing aid 10 and the connecting rod 14 of the positioning device 11 can be pulled from the blind hole 20 of the hearing aid 10.

In order to remove the hearing aid 10 from the auditory canal 12, the reverse procedure (reversed in respect of the insertion of the hearing aid as per FIGS. 2 to 5) should be carried out. Thus, the positioning adapter or the positioning device 11 should be securely coupled to the hearing aid 10 to be removed. To this end, in the example of FIGS. 6 and 7, the pin 22 should be pressed into the tube 21 such that the connecting rod 14 can be guided into the blind hole 20 of the hearing aid. If the pin 22 is released, a spring presses it outward and the special shape of the pin 22 converts this axial movement into a radial movement of the ball 24, and so the latter is pressed into the spherical-cap impression 25, as a result of which there is an interlock with the hearing aid 10. The hearing aid 10 can now be pulled out of the auditory canal using the positioning device 11.

In order to simplify the coupling of the positioning device 11 to the hearing aid 10, the connecting rod 14 or the material surrounding the blind hole 20 can be magnetized. This guides the connecting rod 14 into the blind hole 20 by magnetic means, which is particularly advantageous because the coupling procedure of hearing aid 10 and positioning device 11 cannot be observed by the hearing-aid wearer.

Figure 7:
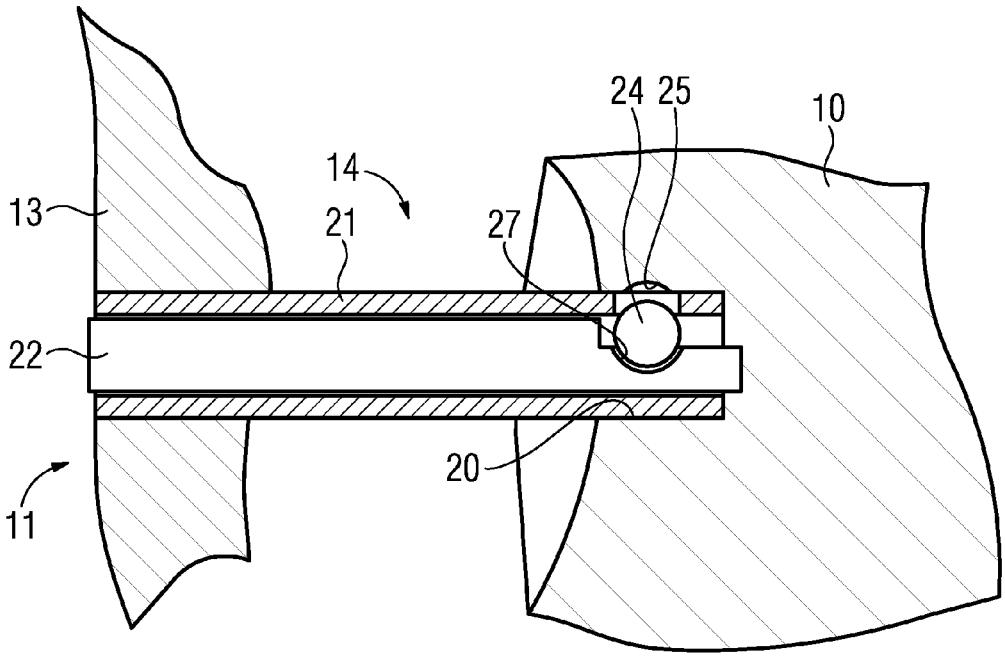
FIG. 7 shows the hearing system from FIG. 6 in the detached state.

As an alternative to the embodiment in FIGS. 6 and 7, the coupling between hearing aid 10 and positioning device 11 can for example also be brought about by a bayonet cap or a swivelable hook. In the latter case the pin 22 for example has a radially protruding section, which can be swiveled into an undercut in the hearing aid 10 by rotating the pin 22 about its axis. In a further alternative embodiment, the positioning device has a hook or a self-clamping claw, by means of which it can be detachably attached to the hearing aid. It is also feasible to attach the positioning device to the hearing aid by magnetic force or by vacuum, i.e., negative pressure. Moreover, the pin 22 can also have an eccentric shape in the region of the ball 24, and so the ball 24 is partly pressed out of the bore 23 by rotating the pin 22 about its axis.

The hearing system presented above, which consists of a hearing device and a positioning device, allows simple insertion of the hearing aid into the auditory canal to be made possible, which can also be carried out by the hearing-aid wearers themselves. The deep insertion of the hearing aid leads to an improved acoustic performance and moreover results in an almost invisible wearing position.

The invention claimed is:

1. A hearing system, comprising:

a hearing device configured for complete insertion into a human auditory canal;

a positioning device releasably attached to said hearing device in a self-retaining manner, wherein said positioning device is detached from said hearing device when said hearing device is inserted in the auditory canal, said positioning device cannot be inserted, or can only be partly inserted, into the auditory canal, and said positioning device serves as an insertion stop on a part of a concha at an entrance to the auditory canal during a positioning of the hearing device in the auditory canal;

said positioning device including a tube and said hearing device being detachably mounted at one end of said tube; and said positioning device including a pin disposed in said tube, said pin being rotatably disposed about an axis thereof or axially displaceable within said tube for detaching said hearing device from said positioning device.

2. The hearing system according to claim 1, wherein said hearing device is individually fitted to the auditory canal.

3. The hearing system according to claim 1, wherein said positioning device is individually fitted to a shape of the entrance to the auditory canal.

4. The hearing system according to claim 1, which further comprises a ball disposed in said tube, and wherein said pin, in a first position thereof, partly presses said ball out of said tube in a radial direction and, in a second position thereof, provides sufficient space in said tube for said ball to be located entirely within a periphery of said tube.

5. The hearing system according to claim 1, wherein said positioning device is detachably attached to said hearing device by way of vacuum suction.

6. The hearing system according to claim 1, wherein said positioning device is detachably attached to said hearing device by way of a magnetic force.

7. A hearing system, comprising:

a hearing device configured for complete insertion into a human auditory canal;

a positioning device releasably attached to said hearing device in a self-retaining manner, wherein said positioning device is detached from said hearing device when said hearing device is inserted in the auditory canal, said positioning device cannot be inserted, or can only be partly inserted, into the auditory canal, and said positioning device serves as an insertion stop on a part of a concha at an entrance to the auditory canal during a positioning of the hearing device in the auditory canal;

said positioning device including a tube or a bolt and said hearing device being detachably mounted at one end of said tube or said bolt; and said positioning device having an undercut section undercutting a projection of said hearing device in a state in which said positioning device is attached to said hearing device, and wherein the undercut is released for detaching said positioning device from said hearing device.

8. The hearing system according to claim 7, wherein said hearing device is individually fitted to the auditory canal.

9. The hearing system according to claim 7, wherein said positioning device is individually fitted to a shape of the entrance to the auditory canal.

10. The hearing system according to claim 7, wherein said positioning device is detachably attached to said hearing device by way of vacuum suction.

11. The hearing system according to claim 7, wherein said positioning device is detachably attached to said hearing device by way of a magnetic force.

12. A hearing system, comprising:

a hearing device configured for complete insertion into a human auditory canal;

a positioning device releasably attached to said hearing device in a self-retaining manner, wherein said positioning device is detached from said hearing device when said hearing device is inserted in the auditory canal, said positioning device cannot be inserted, or can only be partly inserted, into the auditory canal, and said positioning device serves as an insertion stop on a part of a concha at an entrance to the auditory canal during a positioning of the hearing device in the auditory canal;

said positioning device including a tube or a bolt and said hearing device being detachably mounted at one end of said tube or said bolt; and wherein said bolt or said tube is inserted into a recess formed in said hearing device under magnetic guidance for attaching said bolt or tube to said hearing device.

13. The hearing system according to claim 12, wherein said hearing device is individually fitted to the auditory canal.

14. The hearing system according to claim 12, wherein said positioning device is individually fitted to a shape of the entrance to the auditory canal.

15. The hearing system according to claim 12, which further comprises a ball disposed in said tube, and wherein said pin, in a first position thereof, partly presses said ball out of said tube in a radial direction and, in a second position thereof, provides sufficient space in said tube for said ball to be located entirely within a periphery of said tube.

16. The hearing system according to claim 12, wherein said positioning device is detachably attached to said hearing device by way of vacuum suction.

17. The hearing system according to claim 12, wherein said positioning device is detachably attached to said hearing device by way of a magnetic force.

18. A method for positioning a hearing device in a human auditory canal, the method which comprises:

providing positioning device with a tube and a pin movably disposed in said tube;

attaching the positioning device to the hearing device, with the positioning device and the hearing device interconnected in a self-retaining manner;

completely inserting the hearing device into the auditory canal with the aid of the positioning device until the positioning device butts against a part of a concha on an outside of the auditory canal; and detaching the positioning device from the hearing device by rotating the pin or axially moving the pin relative to the tube and removing the positioning device, with the hearing device alone remaining in the auditory canal.

19. A method for positioning a hearing device in a human auditory canal, the method which comprises:

providing a positioning device formed with a tube or a bolt and having an undercut section configured to undercut a projection of the hearing device;

mounting the hearing device to one end of the tube or the bolt of the positioning device with a self-retaining and detachable connection wherein the undercut section of the positioning device undercuts the projection of the hearing device;

completely inserting the hearing device into the auditory canal with the aid of the positioning device until the positioning device butts against a part of a concha on an outside of the auditory canal; and detaching the positioning device from the hearing device by releasing the undercut, and removing the positioning device, with the hearing device alone remaining in the auditory canal.

20. A method for positioning a hearing device in a human auditory canal, the method which comprises:

providing a positioning device formed with a tube or a bolt;

attaching the positioning device to the hearing device by inserting the bolt or the tube into a recess formed in the hearing device under magnetic guidance, and interconnecting the positioning device and the hearing device in a self-retaining manner;

completely inserting the hearing device into the auditory canal with the aid of the positioning device until the positioning device butts against a part of a concha on an outside of the auditory canal; and detaching the positioning device from the hearing device and removing the positioning device, with the hearing device alone remaining in the auditory canal.

* * * * *